US005404617A

United States Patent [19]

Ambasz

[11] Patent Number: 5,404,617

[45] Date of Patent: Apr. 11, 1995

[54] FOLD-DOWN HANDLE

[76] Inventor: Emilio Ambasz, 295 Central Park West, New York, N.Y. 10024

[21] Appl. No.: 163,131

[22] Filed: Dec. 7, 1993

[51] Int. Cl.[6] ..... B45C 13/26; B65D 25/28

[52] U.S. Cl. ..... 16/124; 16/126

[58] Field of Search ..... 16/110 R, 124, 125, 16/126; 190/39, 115

[56] References Cited

U.S. PATENT DOCUMENTS

| | | | |
|---|---|---|---|
| 525,848 | 9/1894 | MaCarthy . | |
| 1,101,273 | 6/1914 | Gluckman . | |
| 2,652,909 | 9/1953 | Knell | 190/58 |
| 3,183,549 | 5/1965 | Hammesfahr | 16/125 |
| 4,261,078 | 4/1981 | Mobley | 16/126 |

*Primary Examiner*—Irene Cuda
*Assistant Examiner*—Kenneth J. Hansen
*Attorney, Agent, or Firm*—Brumbauch, Graves, Donohue & Raymond

[57] ABSTRACT

A fold-down handle for luggage, briefcases, and the like comprises a pair of bracket members adapted to be attached in spaced-apart relation to an article to be carried and a handgrip member extending between and pivotally attached to the bracket members such as to pivot about a pivot axis. The handgrip member and each of the bracket members have abutting end surfaces lying in a plane perpendicular to the pivot axis and peripheral wall surfaces on portions immediately adjacent the end surfaces that are of elliptical cross section about common center axes oblique to the pivot axis. The elliptical peripheral wall surfaces of the end portions intersect the respective end surfaces along circular edges, the centers of which are coincident with the pivot axis. Accordingly, the edges formed at the intersections of the peripheral wall surfaces and end surfaces of the handle member and the respective bracket members coincide with each other in all pivotal positions of the handgrip member.

12 Claims, 3 Drawing Sheets

FOLD-DOWN HANDLE

BACKGROUND OF THE INVENTION

Articles that are commonly carried by hand usually have a carrying handle to facilitate carrying them. Examples of articles that have carrying handles that come to mind immediately are luggage, briefcases, and boxes or cases for tools and instruments of various kinds (e.g., musical instruments, electrical and electronic equipment, photographic and optical equipment, medical equipment and so on).

Generally, carrying handles are constructed so that they collapse or fold in order to reduce the overall size of the article and allow it to be stored or stowed more readily. In the case of carrying handles having rigid handgrip members, folding is provided for in most instances by attaching the handgrip member to the article by means of brackets having pairs of rigid posts spanned by pivot pins to which the ends of a handgrip member are attached. A commonly used bracket design consists of a metal base, metal posts, and a metal pin received in holes in the posts. Manufacture and assembly of such brackets is costly. Moreover, the posts protrude from the case and can harm soft articles, packages and boxes packed with them, such as in car trunks and airplane cargo carriers.

SUMMARY OF THE INVENTION

An object of the present invention is to provide a foldable carrying handle of a rigid type that is inexpensive to manufacture, easy to install, and durable. Another object is to provide such a handle that is of a unique and handsome appearance. Still another object is to provide a foldable handle that is not likely to harm objects that contact the brackets.

The foregoing objects are attained, in accordance with the present invention, by a fold-down handle comprising a pair of bracket members adapted to be attached in spaced-apart relation to an article to be carried and a handgrip member extending between and pivotally attached to the bracket members such as to pivot about a pivot axis. The handgrip member and the bracket members have abutting end surfaces lying in a plane perpendicular to the pivot axis and peripheral wall surfaces on portions immediately adjacent the end surfaces that are of elliptical cross section about center axes oblique to the pivot axis. The elliptical peripheral wall portions intersect the respective end surfaces along circular edges, the centers of which are coincident with the pivot axis. Accordingly, the edges formed at the intersections of the peripheral wall surfaces and end surfaces of the handle member and the respective bracket members coincide with each other in all pivotal positions of the handgrip member.

When the handle is extended, the minor axes of the elliptical wall surfaces of the end portions of the handgrip member and the respective bracket members lie in a common plane with the pivot axis and center axis, all of which intersect at a point lying in the plane of the abutting end surfaces where the respective bracket members meet the ends of the handgrip member.

The center axes of the elliptical-portions are, preferably, straight, though they may have a small curvature. When they are straight, the center axis of the elliptical portion of each bracket and the center axis of the elliptical portion of the adjacent end of the handgrip member should be substantially aligned. When they are curved, the center axis of the elliptical portion of each bracket and the center axis of the elliptical portion of the adjacent end of the handgrip member should be tangent where they intersect at the abutting end surfaces. Since any curvature of the center axes of the end portions makes the edges slightly non-circular so that they do not precisely coincide, anything other than a very moderate curvature is to be avoided.

The shapes of the handgrip member and the brackets remote from the abutting end surfaces where they meet is a matter of choice. In one embodiment, the handgrip member is of a uniform substantially elliptical cross-section throughout its length and is smoothly curved along its length (i.e., the center axis is smoothly curved). Similarly, the bracket members may be of uniform substantially elliptical cross-section along their lengths and have curved center axes.

In preferred embodiments, the bracket members and the handgrip member are molded of a polymeric material, but the invention is not limited to such materials and methods of manufacture.

Preferably, the pivot connection between the handgrip member and each bracket member includes a pin affixed to the handgrip member and protruding from the end surface along the pivot axis and a hole in each bracket member receiving the pin. Advantageously, each pin has a shank portion and an enlarged head portion spaced apart from the end surface of the handgrip member, and the hole in the bracket member receiving the pin has a cross-section matching the shape of the pin.

In a particularly preferred design, which can be mass-produced and assembled at low cost, each bracket member has a base wall adapted to abut the article to which it is attached and the hole receiving the pin on the handgrip portion is a generally T-shaped slot extending along the end surface of the bracket member from the base wall to the pivot axis. The slot permits the handgrip member to be attached to the bracket by sliding the pin into the slot from the bottom. A keeper member received in the slot and extending between the base wall and the pin retains the pin in the slot at the pivot axis. Both the bracket members and the handgrip member can be molded of a polymeric material, the pins being molded integrally with the handgrip member.

For a better understanding of the invention, reference may be made to the following description of an exemplary embodiment, taken in conjunction with the accompanying drawings.

DESCRIPTION OF THE EMBODIMENT

Figure 14:
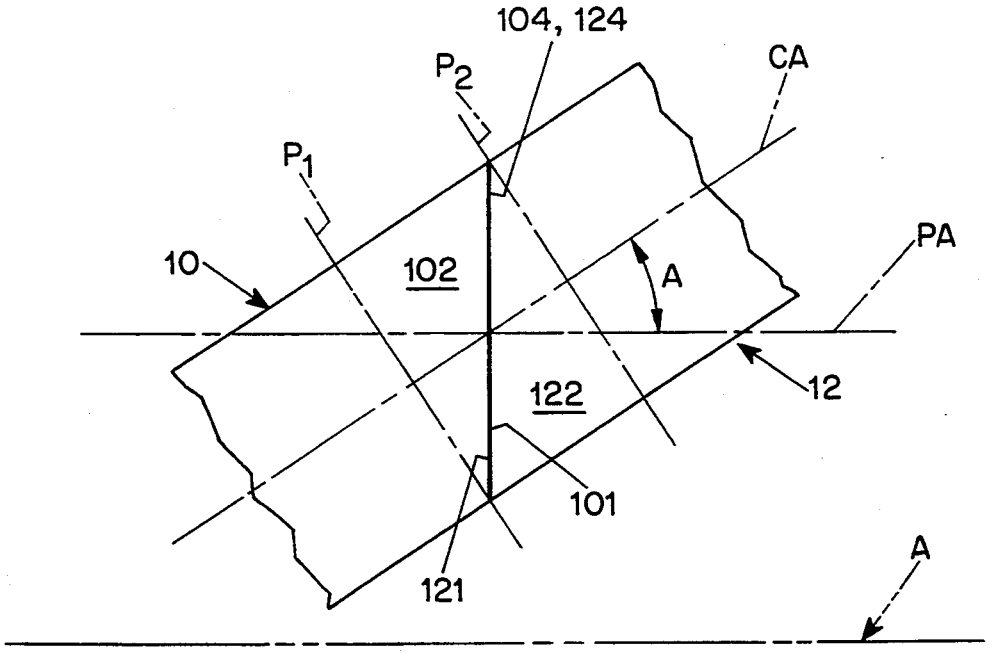
FIG. 14 is a diagram of the juncture between a bracket member and one end of the handgrip member.

The embodiment of a fold-down handle shown in the drawings comprises a pair of bracket members 10, which are adapted to be attached in spaced apart relation to an article A to be carried, and a handgrip member 12 extending between and pivotally attached to the bracket members such as to pivot about a pivot axis PA (FIG. 14). The handgrip member and the bracket members have abutting end surfaces 101 and 121, respectively, that lie in a plane perpendicular to the pivot axis PA and have peripheral wall surfaces 102 and 122, respectively, on portions immediately adjacent the end surfaces having a common center axis CA (FIG. 14) oblique to the pivot axes. Each peripheral wall surface 102 and 122 is of uniform elliptical cross section with respect to the center axis CA and intersects the respective end surface along a circle having its center coincident with the pivot axis PA so that edges 104 and 124, respectively, formed by the intersecting of the peripheral wall surfaces and the end surfaces of the handle member 12 and the respective bracket members 10 coincide with each other in all pivotal positions of the handgrip member.

By definition, an ellipse is the line of intersection between a circular cylindrical surface and a plane that intersects that surface and is oblique to the axis of the cylindrical surface. The minor diameter of an ellipse is, of course, equal to the diameter of the cylindrical surface. The major diameter of the ellipse is a function of the angle at which the plane intersects the axis of the cylindrical surface in a plane that includes the cylinder axis and is perpendicular to the minor diameter. An elliptical cylindrical surface is a surface generated by rotating a line along an ellipse about a center axis perpendicular to the plane of the ellipse, keeping the line parallel to the center axis of the ellipse. Because an elliptical surface originated from a circle, there is for any elliptical surface a particular plane that is oblique to the axis and intersects the elliptical surface at a circular line. The present invention makes use of that characteristic of an ellipse by having matching elliptical surfaces on end portions of the bracket members and handgrip member immediately adjacent abutting end surfaces that lie obliquely to the axes of the ellipses. The major diameters of the elliptical surfaces in the end portions are selected so that the abutting end surfaces of the handgrip member and the bracket members are circular. Accordingly, the edges formed by the intersections of the end surfaces with the elliptical peripheral surfaces are circular and coincide in all pivotal positions of the handgrip member relative to the bracket member, about the pivot axis.

As shown diagrammatically in FIG. 14, an end portion 102 of each bracket member 10 and an end portion 122 of the handgrip member 12 are of uniform elliptical cross-section. The minor diameter of the ellipse lies in the plane of the paper and perpendicular to the center axis CA. The major diameter of the ellipse lies perpendicular to the plane of the paper and is chosen so that the abutting end surfaces 102, 122 of the bracket members, which are perpendicular to the pivot axis PA of the handgrip member, will be bounded by circles 104, 124 and will coincide in all pivotal positions of the handgrip member. If the angle between the pivot axis PA and the center axis CA of the end portions is A, the relationship of the minor axis to the major axis of the ellipse that will provide circular ends is $D_{minor}=D_{major}\cdot\tan A$.

In order to have circular end surfaces that exactly coincide, the center axes CA of the end portions of the respective bracket members and the corresponding end portion of the handgrip member must be in alignment and must be straight. If they are curved or are not in alignment the ends will not be exactly circular or will not coincide. However, it is sufficient that only end portions lying between planes perpendicular to the center axis and intersecting the extreme axial ends of the respective members, the planes P1 and P2 of FIG. 14, be matching elliptical surfaces. Moreover, substantially circular ends that substantially coincide, within acceptable tolerances, can be attained with slight curvatures or slight misalignments of the center axes.

Figure 1:
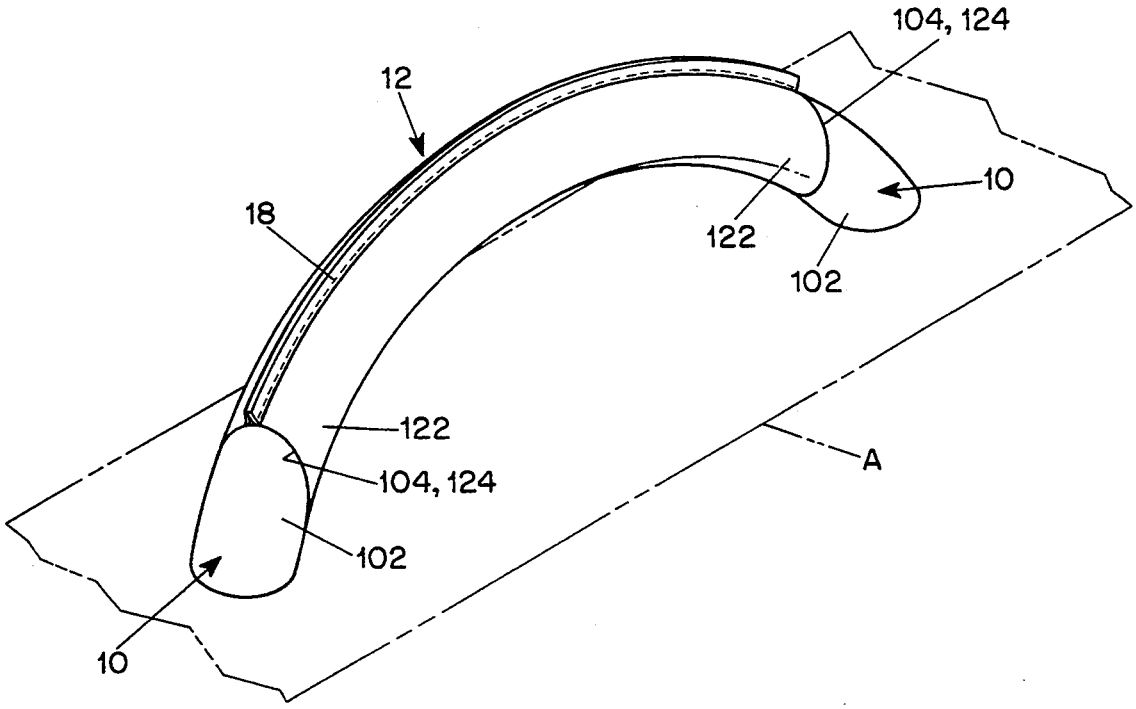
FIGS. 1 and 2 are pictorial views of the embodiment, showing the handle extended and folded down, respectively.
Figure 2:
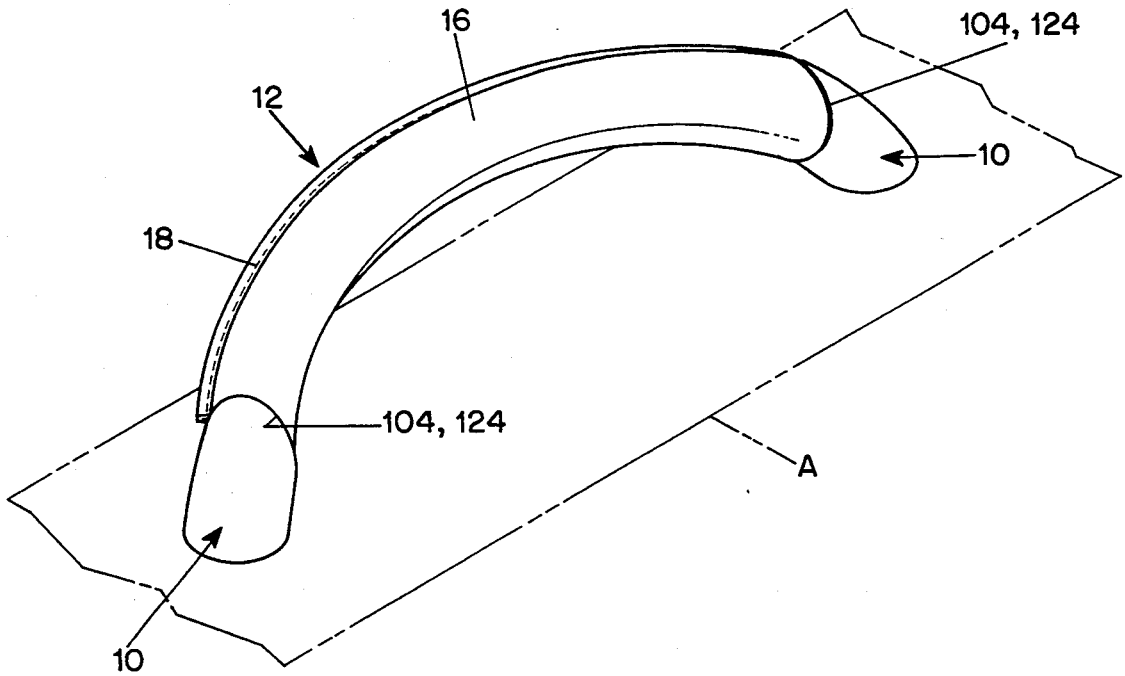
Figure 3:
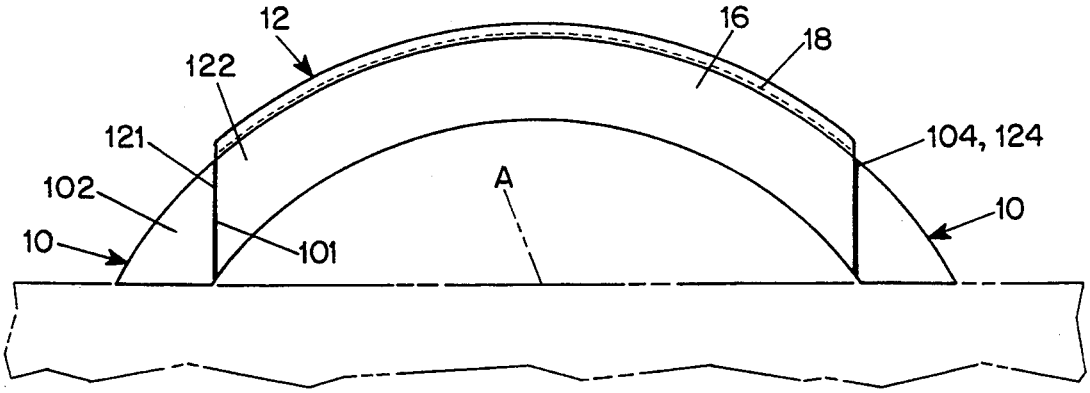
FIGS. 3 and 4 are side elevational views of the embodiment, showing the handle extended and folded down, respectively.
Figure 4:
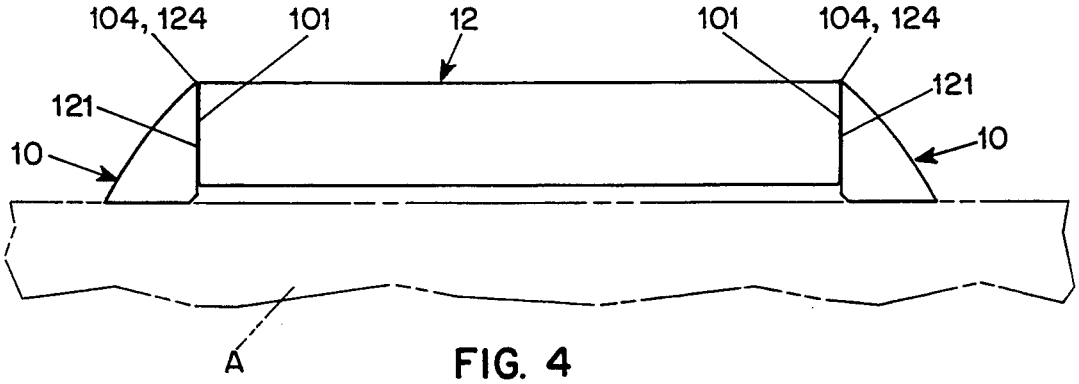
Figure 5:
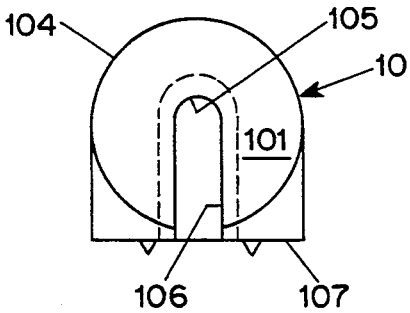
FIGS. 5 to 7 are end elevational, side elevational and bottom plan views, respectively, of a bracket member of the embodiment.
Figure 6:
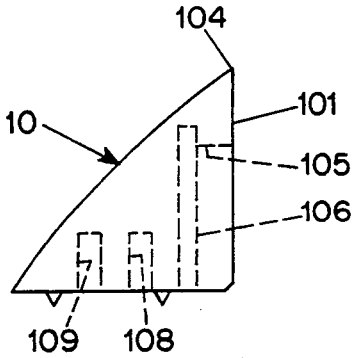
Figure 7:
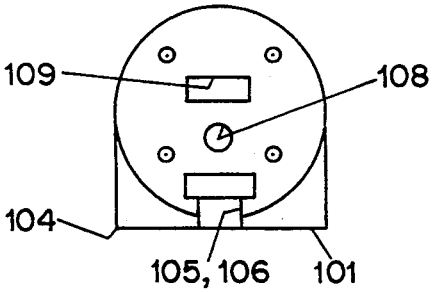
Figure 8:
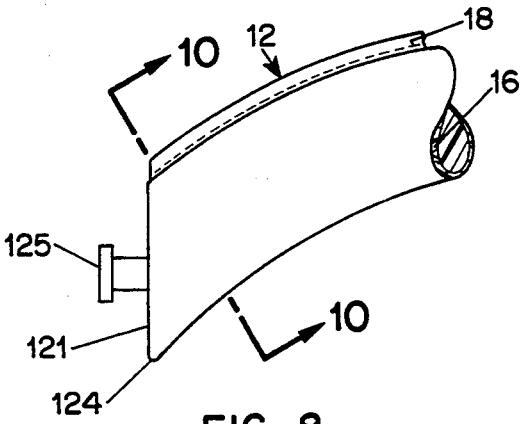
FIG. 8 is a fragmentary side elevational view of an end portion of the handgrip member.
Figure 9:
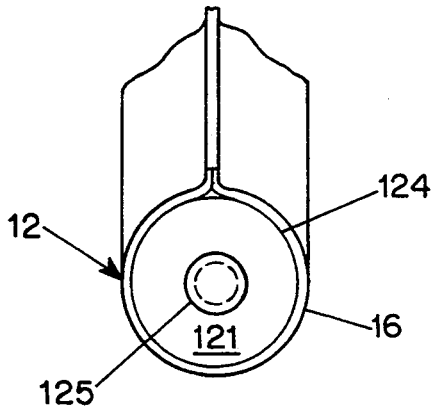
FIG. 9 is an end cross-sectional view of the handgrip member taken orthogonally to its center axis along the lines 9—9 of FIG. 8.
Figure 10:
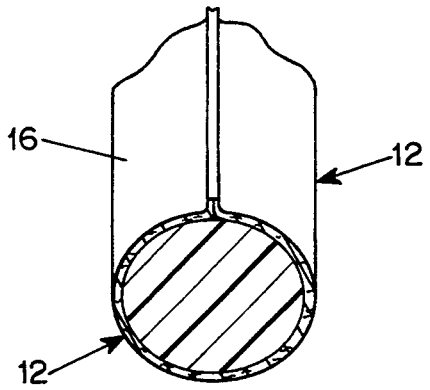
Figure 11:
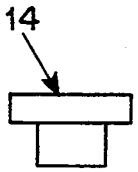
FIGS. 11, 12, and 13 are bottom plan, end elevational and side elevational views of a keeper.
Figure 12:
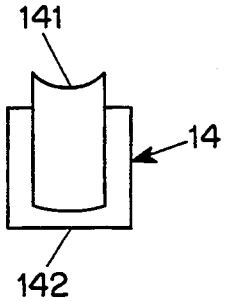
Figure 13:
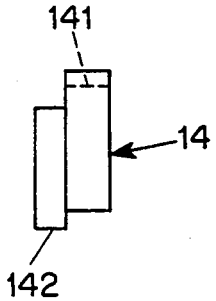

In addition to having brackets and a handgrip with elliptical end portions that provide coincidence between the edges of the abutting ends in all pivot positions, the embodiment has an advantageous structure. Both the brackets and the handgrip are molded from a suitable polymeric material. The brackets may be identical to each other. The pivot connections are provided by integral pivot pin portions 125 projecting from each end of the handgrip 12 along the pivot axis and a hole 105 molded into the end portion 102 of the bracket 10. The pivot pins 125 have a shank portion **125*a* and an enlarged head portion 125*b*. The hole 105 is an end portion of a slot 106 molded into the end surface 101 of the bracket from its lower extremity and having a cross-sectional shape matching that of the pin 125. A molded keeper 14 (FIGS. 11 to 13) matching the slot is received in the lower part of the slot and retains the pin at the pivot axis by engagement of its upper end 141 with the underside of the pin 125. When, as shown and preferred, the base wall 107 of the bracket intersects the lowermost extremity of the end wall 101, the keeper 14 is held in place in the slot when the handle is installed on an article by engagement of its lower end 142** with the surface of the article A to which the handle is affixed.

The bracket has a screw hole 108 for a fastening screw and a recess 109 that receives a positioning boss (not shown) on the article or a washer received within the article to prevent the bracket from rotating about the screw. Acceptance of the headed pivot pins 125 in the undercut slot 106 provides assurance that the handgrip will not pull loose from the brackets. All three parts of the embodiment can be molded in simple two part molds. Assembly involves simply sliding a bracket onto each pivot pin, pressing a keeper into place in each bracket and fastening each bracket to the article with a single screw.

The graceful and streamlined appearance of the embodiment can be enhanced, as shown, by covering the handgrip with a cover 16 of natural or synthetic leather, which is secured by an adhesive and stitched along the tops (stitching 18).

I claim:

1. A fold-down handle comprising a pair of bracket members adapted to be attached in spaced apart relation to an article to be carried and a handgrip member extending between and pivotally attached to the bracket members such as to pivot about a pivot axis, the handgrip member and the bracket members having abutting end surfaces lying in a plane perpendicular to the pivot axis and having peripheral wall surfaces on end portions immediately adjacent the end surfaces having center axes oblique to the pivot axes, each peripheral wall surface being of uniform elliptical cross section with respect to the center axis and intersecting the respective end surface along a circle having its center coincident with the pivot axis so that edges formed by the peripheral wall surfaces and end surfaces of the handle member and the respective bracket members coincide with each other in all pivotal positions of the handgrip member.

2. A handle according to claim 1 wherein when the handle is extended the minor axes of the elliptical wall surfaces of the end portions of the handgrip member and bracket members lie in a common plane with the pivot axis and center axis.

3. A handle according to claim 2 wherein a body portion of the handgrip member between the end portions is of substantially uniform approximately elliptical cross-section corresponding substantially to the cross-sections of the end portions throughout its length.

4. A handle according to claim 3 wherein the center axis of the body portion of the handgrip member is smoothly curved along its length.

5. A handle according to claim 3 wherein the bracket members are of substantially uniform elliptical cross-section along their lengths.

6. A handle according to claim 1 wherein a body portion of the handgrip member between the end portions is of substantially uniform approximately elliptical cross-section corresponding substantially to the cross-sections of the end portions throughout its length.

7. A handle according to claim 1 wherein the bracket members and the handgrip member are molded of a polymeric material.

8. A handle according to claim 1 wherein the pivot connection between the handgrip member and each bracket member includes a pin affixed to the handgrip member and protruding from the end surface along the pivot axis and a hole in each bracket member receiving the pin.

9. A handle according to claim 8 wherein each pin has a shank portion and an enlarged head portion spaced apart from the end surface of the handgrip member and the hole in the bracket member receiving the pin has a cross-section matching the shape of the pin.

10. A handle according to claim 9 wherein each bracket member has a base wall adapted to abut the article to which it is attached and the hole receiving the pin on the handgrip portion is a generally T-shaped slot extending along the end surface of the bracket member from the base wall to the pivot axis.

11. A handle according to claim 10 and further comprising a keeper member received in the slot and extending between the base wall and the pin so as to retain the pin in the slot at the pivot axis.

12. A handle according to claim 10 wherein the bracket members and the handgrip member are molded of a polymeric material and the pins are integral and unitary with the handgrip member.

* * * * *